US007147904B1

(12) United States Patent
Crawford

(10) Patent No.: US 7,147,904 B1
(45) Date of Patent: Dec. 12, 2006

(54) EXPANDABLE TUBULAR FABRIC

(75) Inventor: Julian Crawford, Spartanburg, SC (US)

(73) Assignee: Evelyn Florence, LLC, Spartanburg, SC (US)

( * ) Notice: Subject to any disclaimer, the term of this patent is extended or adjusted under 35 U.S.C. 154(b) by 152 days.

(21) Appl. No.: 10/634,166

(22) Filed: Aug. 5, 2003

(51) Int. Cl.

| | |
|---|---|
| ***B32B 1/08*** | (2006.01) |
| ***D02G 3/02*** | (2006.01) |
| ***B65D 85/20*** | (2006.01) |
| *B29D 22/00* | (2006.01) |
| *B29C 47/00* | (2006.01) |

(52) U.S. Cl. ..... 428/36.1; 428/36.3; 428/36.9; 428/36.92; 428/376; 428/377; 57/210; 57/230; 57/231; 206/446; 174/69; 174/DIG. 8; 174/DIG. 11; 138/118; 138/123; 138/124; 138/125

(58) Field of Classification Search ..... 428/36.1, 428/36.3, 36.9, 36.92, 376, 377; 57/210–213, 57/230, 231; 174/69, DIG. 8, DIG. 11; 206/446; 138/118, 123, 124, 125, 129, 137, 140, 141, 138/144

See application file for complete search history.

(56) References Cited

U.S. PATENT DOCUMENTS

| | | | | |
|---|---|---|---|---|
| 2,321,512 | A | 6/1943 | Protz | 57/6 |
| 3,123,512 | A | 3/1964 | Mercer | 156/441 |
| 3,477,892 | A | 11/1969 | Plymale | 156/167 |
| 4,017,579 | A | 4/1977 | Roe | 264/174 |
| 4,228,641 | A * | 10/1980 | O'Neil | 57/234 |
| 4,411,722 | A | 10/1983 | Yazawa | 156/167 |
| 4,791,240 | A | 12/1988 | Marin | 174/23 |
| 5,213,644 | A | 5/1993 | Phillips | 156/51 |
| 5,564,476 | A * | 10/1996 | Golz | 139/388 |
| 5,572,860 | A * | 11/1996 | Mitsumoto et al. | 57/224 |
| 5,613,522 | A * | 3/1997 | Ford et al. | 138/123 |
| 6,013,341 | A * | 1/2000 | Medvedev et al. | 428/36.3 |
| 6,318,061 | B1 | 11/2001 | Schneider | 57/7 |
| 2004/0068972 | A1 * | 4/2004 | Kanno et al. | 57/210 |

* cited by examiner

*Primary Examiner*—Jennifer C. McNeil
*Assistant Examiner*—Chris Bruenjes

(57) ABSTRACT

An expandable tubular fabric formed by heat setting a plurality of thermoplastic yarns producing drawn thermoplastic yarns, arranging these yarns in an array and in juxtaposed positions and moving them in a first direction. Extruding at least one filament along a circular or other shaped path about the moving array of drawn yarns and causing the extruded filament(s) to bond with the array of yarns. Finally, setting the extruded filament in bonded position with the array of yarns holding them in relative fixed positions and forming the fabric stable.

8 Claims, 2 Drawing Sheets

EXPANDABLE TUBULAR FABRIC

BACKGROUND OF THE INVENTION

The invention is directed to the method of forming an expandable tubular fabric which may be used as a protective cover for bundled elements such as wires, cables, or other elements requiring protection or bundling, in areas such as automobile bodies, airplane bodies, pipes, houses, tunnels etc. The invention also includes the fabric structure and the method of forming the fabric.

Tubular fabrics used as protective shields are well known in the industry for use as indicated above. The majority of these shields are formed by braiding, however, others may be formed by knitting or weaving. Each of these referred to forming methods are relatively slow, and therefore, are relatively costly.

Accordingly, it is a primary object of the invention to provide a method of forming an expandable tubular fabric which is both faster than known methods, and therefore, less costly.

Another object of the invention is the provision of a tubular fabric which is both expandable and longitudinally dimensionally stable.

Another object of the invention is an expandable tubular fabric formed by bonding the filaments or yarns forming the fabric in position.

Another object of the invention is the provision of an expandable tubular fabric in which the longitudinal yarns maintain their relative positions during expansion or contraction of the tube.

Another object of the invention is an expandable tubular fabric comprised of longitudinally extended yarns arranged about an accurate path and secured in position by bonding one or more helically wrapped yarns with their outer surfaces.

Another object of the invention is an expandable tubular fabric with an open structure, through which the internally carried elements can be extended.

SUMMARY OF THE INVENTION

The term yarn is defined as a product of substantial length, small cross section consisting of fibers and/or filament(s) with or without twist.

The invention is directed to an expandable tubular fabric or sleeve and the method of forming such a sleeve.

The method includes the steps of providing an array of parallel yarns and continuously moving these yarns in a first direction along an axis and through a forming device. Providing a mandrel along the axis of movement and arranging the yarns about the mandrel during movement through the device. Providing an extruding member and arranging the extruding member about the mandrel and the array of yarns. Causing the extruding member to rotate about the mandrel and the yarns while extruding one or more filament and causing the extruded filament(s) to bond with the yarns as the extruding member rotates around the mandrel securing the yarns in their relative positions.

The method also includes providing the yarns forming the array of yarns comprise any one or combination of nylon, polyester, polypropylene, polyethylene or other thermoplastic polymer and the extruded wrapping filament comprise a thermoplastic polymer.

The method includes arranging the array of parallel yarns so that adjacent ones are substantially close to or in contact with one another. Also one or more filaments may be simultaneously extruded and wrapped about the yarns.

The method includes extruding and passing the array of yarns over a plurality of stretching rolls and heat setting them in drawn condition before passing them through the forming device. Alternatively, preformed filaments or yarns could be used as the parallel array of yarns.

The term filament is defined as a fiber of indefinite length.

An expandable tubular fabric which includes a plurality of drawn longitudinal thermoplastic filaments of a first size arranged along a radial or an ellipsoid path in juxtaposed positions forming an elongated tube. One or more thermoplastic filaments of a larger, equivalent or smaller size is (are) helically wrapped about and bonded to the drawn longitudinal filaments securing and maintaining them in fixed position. The drawn longitudinal filaments may be arranged so that adjacent ones are in contact along their length or are slightly or widely spaced. The helical wrap(s) is (are) arranged to be longitudinally spaced or alternatively criss-crossed along the length of the drawn longitudinal filaments.

The helical thermoplastic filament(s) and (or) the drawn longitudinal thermoplastic filaments may have a profiled cross-section or a circular cross-section as desired.

A method of forming a tubular fabric which includes the steps of:

- heat setting a plurality of thermoplastic yarns producing drawn longitudinal thermoplastic yarns;
- arranging the drawn longitudinal yarns in an array about a radial or an ellipsoid path in juxtaposed positions and moving the drawn longitudinal yarns in a first direction;
- extruding one or more filaments along a circular or other shaped path about the moving array of drawn longitudinal yarns causing the extruded filament(s) to bond with the drawn longitudinal yarns; and,
- setting the extruded and bonded filament(s) in position with the array of drawn longitudinal yarns forming an expandable tubular structure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The term expandable tubular fabric is intended to describe an expandable tubular sheath which may be used to encase wires, cables, or bundled elements to provide protection or structure.

Figure 1:
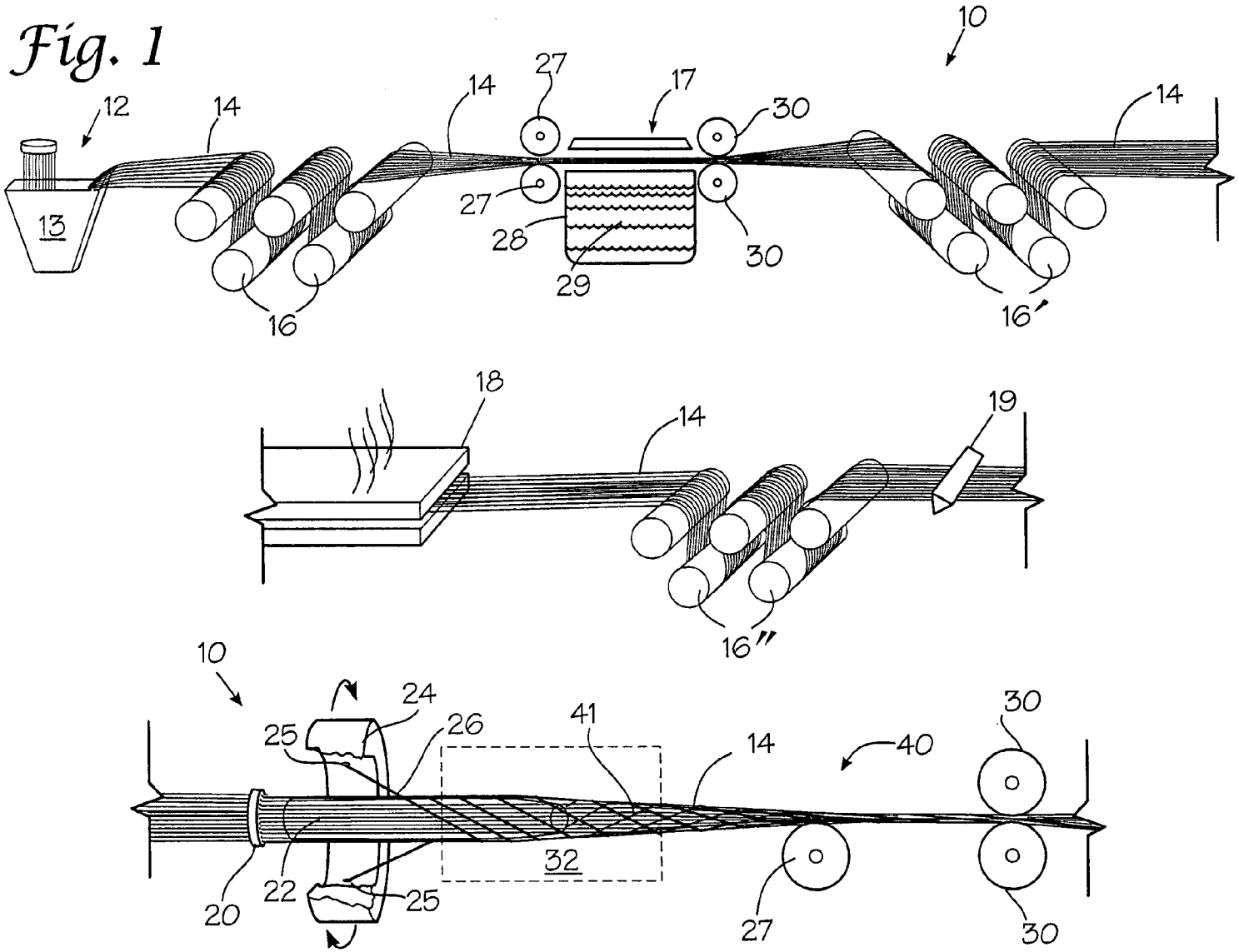
FIG. 1 is a diagrammatic perspective view of the arrangement forming the expandable tubular fabric of the invention.

Turning now to FIG. 1, an arrangement 10 is shown for forming the expandable tubular fabric 40 of the invention. Yarns 14 are shown being drawn from supply or extruder 12 and passed through a quench tank 13. The yarns 14 then are directed around a plurality of draw rolls 16, through one or more stretch baths 17, and across additional draw rolls 16'. Successive roll stands rotate at higher speeds thereby drawing the yarns 14. The drawn yarns 14 are passed through one or more heat set ovens 18 to fix the desired elongation characteristics of the array of yarns 14 and then through additional draw rolls 16".

It is noted that yarns 14 may alternatively comprise pre-formed yarns delivered from spools and pre-stretched and set to already have the desired elongation characteristics.

Arranged downstream of the last rollstand 16" is a horizontal comb 19 and a circular combed guide or base plate with guide holes 20. Just downstream of comb 20 is a horizontally disposed circular, or other shaped and preferably tapered mandrel 22 of pre-selected diameter. Positioned over mandrel 22 is one or more rotating extruder(s) 24 each having one or a plurality of extruding dies 25. Arranged downstream of mandrel 22 is a quench zone 32 into which the mandrel extends. Beyond the quench zone is a guide roll 27 and take-up rolls 30 leading to the take-up winding apparatus.

In operation, yarns 14 are heat set as earlier described, then passed through combs or guide plates 19 and 20 with comb or guide plate 20 arranging the horizontally extended yarns in selected spaced positions in an arc about mandrel 22. The yarns are retained in these positions as they pass along the length of the mandrel.

Simultaneously with the movement of yarns 14 along mandrel 22, extruder(s) 24 is (are) rotated in the direction of the arrow extruding one or more filaments 26 from die(s) 25 which is (are) wrapped about yarns 14 as they pass along mandrel 22. Filament(s) 26 is (are) disposed in selected spaced positions in the form of helical coils about the yarns 14. As filament(s) 26 is (are) in molten form as they exit from die(s) 25 upon engagement with longitudinal yarns 14, filament(s) 26 bond with longitudinal yarns 14 securing the filament(s) and the longitudinal yarns in fixed position, forming coils or helix 41 about longitudinal yarns 14 forming tubular fabric 40.

It is noted that while two dies 25 as shown are preferred, one may be sufficient or more than two may be desirable. The spacing of the helical coils 41 can be varied and is determined by the relative speeds of rotating extruder 24 and the movement of longitudinal yarns 14. The number of helical filaments being extruded also figures in the spacing of the helical coils. It is noted that a pair of rotating extruders rotating in opposite directions may be provided. In this event the helical filaments 26 will become crossed.

Any number of synthetic materials may be used to form longitudinal yarns 14 and helical filaments 26 may be formed of any thermoplastic polymers, however, nylon, polyester, polyethylene and polypropylene are preferred.

The yarns may be of any plurality of cross sections including round, square, profiled and rectangular. It is preferred that yarns 14 have a round cross section and filament(s) 26 a profiled cross section. Also, the relative yarn diameters may also vary as desired. It is preferred that yarns 14 be less than half the diameter of helical filament(s) 26.

Figure 2:
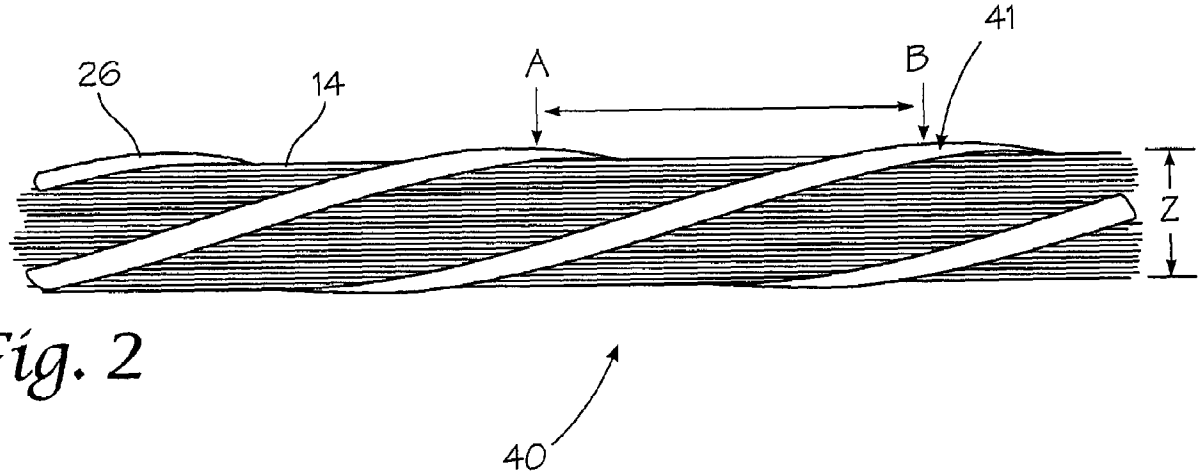
FIG. 2 is a side view of the expandable tubular fabric in relaxed condition.
Figure 3:
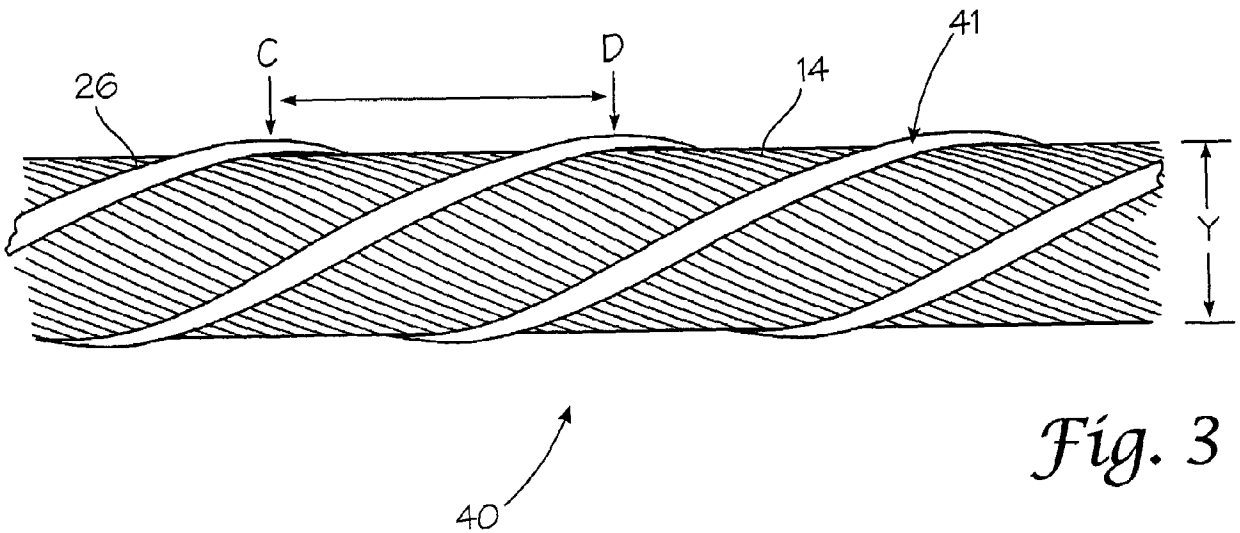
FIG. 3 is a side view of the expandable tubular fabric in expanded condition.

Turning now to FIGS. 2 and 3. In FIG. 2, fabric 40 can be seen in the relaxed state. In this position, longitudinal yarns 14 extend along a single axis horizontally while helical filament(s) 26 is (are) wrapped about longitudinal yarns 14 forming evenly spaced helical coils 41. It can be seen that longitudinal yarns 14 are evenly spaced from each other in the radial direction. The internal diameter of the tube is indicated as Z.

FIG. 3 shows the same fabric structure except that tubular fabric 40 is now in expanded condition. In this condition both longitudinal yarns 14 and helical filament(s) 26 appear to spiral about a longitudinal axis. It is important to note that longitudinal yarns 14 continue to be spaced evenly to adjacent longitudinal yarns 14 as when the fabric is relaxed as in FIG. 2. This feature is important when fabric 40 is employed as a protective sheath. This characteristic provides that similar protection is afforded the encased object about the periphery of fabric 40. Notice that the turns per unit length (distance C to D) are greater for the helical filament in the expanded tubular fabric than the relaxed fabric (A to B). In addition, the internal diameter of the tube (Y) is greater in the expanded fabric than that of the relaxed fabric. (z)

Other uses clearly are available.

While a preferred embodiment of the invention has been described using specific terms, such description is for illustrative purposes only, and it is to be understood that changes and variations may be made without departing from the spirit or scope of the following claims.

What is claimed is:

1. An expandable tubular fabric comprising:

a plurality of longitudinally extending thermoplastic filaments which are drawn and heat set to have first elongation capabilities and are arranged along an ellipsoid path in juxtaposed positions forming an elongated tube;

at least one elastic thermoplastic filament having second elongation capabilities greater than said first elongation capabilities which are helically wrapped about and bonded to said longitudinally extending drawn and heat set thermoplastic filaments forming helical wraps, said helically disposed elastic thermoplastic filament bonding with said longitudinally extending drawn and heat set thermoplastic filaments maintaining each said longitudinally extending drawn and heat set thermoplastic filament in fixed position relative to the adjacent said longitudinally extending drawn and heat set thermoplastic filaments wherein;

said longitudinally extending drawn and heat set thermoplastic filaments maintain their relative positions in said tubular fabric during use.

2. The fabric according to claim 1 wherein said longitudinally extending drawn and heat set thermoplastic filaments are of a first size and said elastic thermoplastic filaments are of a second size, said second size being at least twice the size of said first size.

3. The fabric according to claim 1 wherein each of said longitudinally extending drawn and heat set thermoplastic filaments are substantially engaged with the adjacent said longitudinally extending drawn and heat set thermoplastic filaments along its length.

4. The fabric according to claim 1 wherein said helical wraps formed by said elastic thermoplastic filament are longitudinally spaced along the length of said longitudinally extending drawn and heat set thermoplastic filaments.

5. The fabric of claim 1 wherein said helically wrapped elastic thermoplastic filament has a profiled cross-section.

6. The fabric of claim 1 wherein said helically wrapped elastic filament has a circular cross-section.

7. The fabric of claim 1 wherein said longitudinally extending drawn and heat set thermoplastic filaments have a circular cross-section.

8. The fabric of claim 1 wherein said longitudinally extending drawn and heat set thermoplastic filaments have a profiled cross section.

* * * * *